United States Patent [19]

Melander et al.

[11] 4,128,325

[45] Dec. 5, 1978

[54] AUTOMATIC DENSITY MEASUREMENT CALIBRATION FOR PHOTOGRAPHIC REPLENISHMENT SYSTEM

[75] Inventors: Theodore A. Melander; Ralph L. Charnley, both of Minneapolis, Minn.

[73] Assignee: Pako Corporation, Minneapolis, Minn.

[21] Appl. No.: 802,061

[22] Filed: May 31, 1977

[51] Int. Cl.[2] ..... G03D 13/00

[52] U.S. Cl. ..... 354/298; 354/324

[58] Field of Search ..... 354/297, 298, 324; 250/252, 559; 356/202, 203

[56] References Cited

U.S. PATENT DOCUMENTS

| | | | |
|---|---|---|---|
| 3,554,109 | 1/1971 | Street et al. | 354/298 |
| 3,559,555 | 2/1971 | Street | 354/298 |
| 4,057,818 | 11/1977 | Gaskell et al. | 354/298 |

*Primary Examiner*—Stephen J. Tomsky
*Assistant Examiner*—W. J. Brady
*Attorney, Agent, or Firm*—Kinney, Lange, Westman and Fairbairn

[57] ABSTRACT

A replenisher system for photographic processors includes an automatic calibration system. A film sensor senses when film approaches the density sensor (and guarantees that the sensor is clear), and the automatic calibration system calibrates the density sensor (or other film parameter sensor) of the replenisher system prior to the film reaching the density sensor. The automatic calibration is performed each time a strip of film enters the processor, and reaches the density sensor, thereby assuring that drift and other variations in density sensor output unrelated to the film density are eliminated. In addition, the automatic calibration system provides a data valid signal after the density sensor has been calibrated to allow the replenisher control to accept the output signals from the density sensor and control the supply of replenisher fluid to the processor only for a limited time interval after calibration (i.e. while film is actually present in the density sensor).

16 Claims, 2 Drawing Figures

AUTOMATIC DENSITY MEASUREMENT CALIBRATION FOR PHOTOGRAPHIC REPLENISHMENT SYSTEM

BACKGROUND OF THE INVENTION

The present invention relates to automatic replenisher systems for processors of photosensitive material. In particular, the present invention relates to an automatic calibration system which calibrates a sensor (such as a density sensor) of an automatic replenisher to eliminate inaccuracies in the sensor output caused by temperature variations, drift, and the like.

Photographic processors require replenishment of the processing fluids to compensate for the lowered chemical activity of the fluid which results from processing of the photosensitive film or paper. Replenishment systems originally were manually operated. The operator would visually inspect the film being processed and would manually operate the replenisher system as he deemed necessary. The accuracy of manual replenisher systems is obviously dependent upon the skill and experience of the operator.

In recent years, automatic replenishment systems have found increasing use. These systems typically utilize film density measurements and, in some cases, film speed measurements to control the operation of the replenishment system. Examples of automatic replenishment systems are shown in U.S. Pat. No. 4,057,818 by Gaskell and Charnley, and Ser. No. 4,104,670 by Charnley and Kumpula, both of which are assigned to the same assignee as the present application. Other examples of automatic replenisher systems may be found in U.S. Pat. Nos. 3,529,529 and by Shumacher; 3,559,555 by Street; U.S. Pat. No. 3,561,344 by Frutiger, et. al.; U.S. Pat. No. 3,696,728 by Hope; U.S. Pat. No. 3,752,052 by Hope, et. al.; U.S. Pat. No. 3,822,723 by Crowell, et. al.; U.S. Pat. No. 3,927,417 by Kinoshita, et. al.

The density sensors used in these automatic replenisher systems typically produce an analog density signal which is indicative of the density of the processed film. The density signal, however, can vary due to causes unrelated to the density of the film. For example, long term drift can cause a gradual change in the density signal totally unrelated to film density. In addition, the density sensor is often temperature sensitive so that in those systems in which the density sensor is positioned near a photographic dryer, the variations in the dryer temperature can cause erroneous fluctuations in the density signal.

In the past, some automatic replenisher systems have included a manual calibration adjustment for the density sensor. When the operator decides to calibrate the density sensor, he monitors or watches calibration outputs such as meters or lights and calibrates the density sensor by adjusting a dial until the desired calibration output is achieved. A manual calibration system, however, has several disadvantages. First, the accuracy of the calibration is operator dependent. Second, the calibration is time consuming for the operator. Third, the calibration is dependent upon the operator actually deciding to calibrate the density sensor. The accuracy of the system obviously depends on how often the operator decides to manually calibrate the density sensor.

SUMMARY OF THE INVENTION

The present invention is an automatic calibration system for use in a replenishment system for a processor of photosensitive material. The present invention includes a photosensitive material sensing means which senses when photosensitive material approaches a photosensitive material parameter sensing means (such as a density sensor). When photosensitive material is sensed approaching the parameter sensing means, calibration means monitors the signal from the parameter sensing means and provides a calibration signal which automatically calibrates the parameter sensing means. This calibration is performed before the photosensitive material reaches the parameter sensing means.

The present invention may also include gating means which produces a "data valid" or "gating" signal which allows the replenisher control to accept and use the signal from the parameter sensing means for only a limited period of time after the parameter sensing means has been calibrated. This eliminates long term drift and other noise problems by permitting the replenisher control to operate only for a limited period of time after the parameter sensing means has been calibrated and the photosensitive material is passing the parameter sensing means.

The present invention clearly overcomes the disadvantages of the prior art systems. The calibration of the parameter sensing means is automatic, it occurs each time photosensitive material approaches the parameter sensing means, and is totally independent of the influence of the operator.

DETAILED DESCRIPTION OF THE PREFERRED EMBODIMENTS

Figure 1:
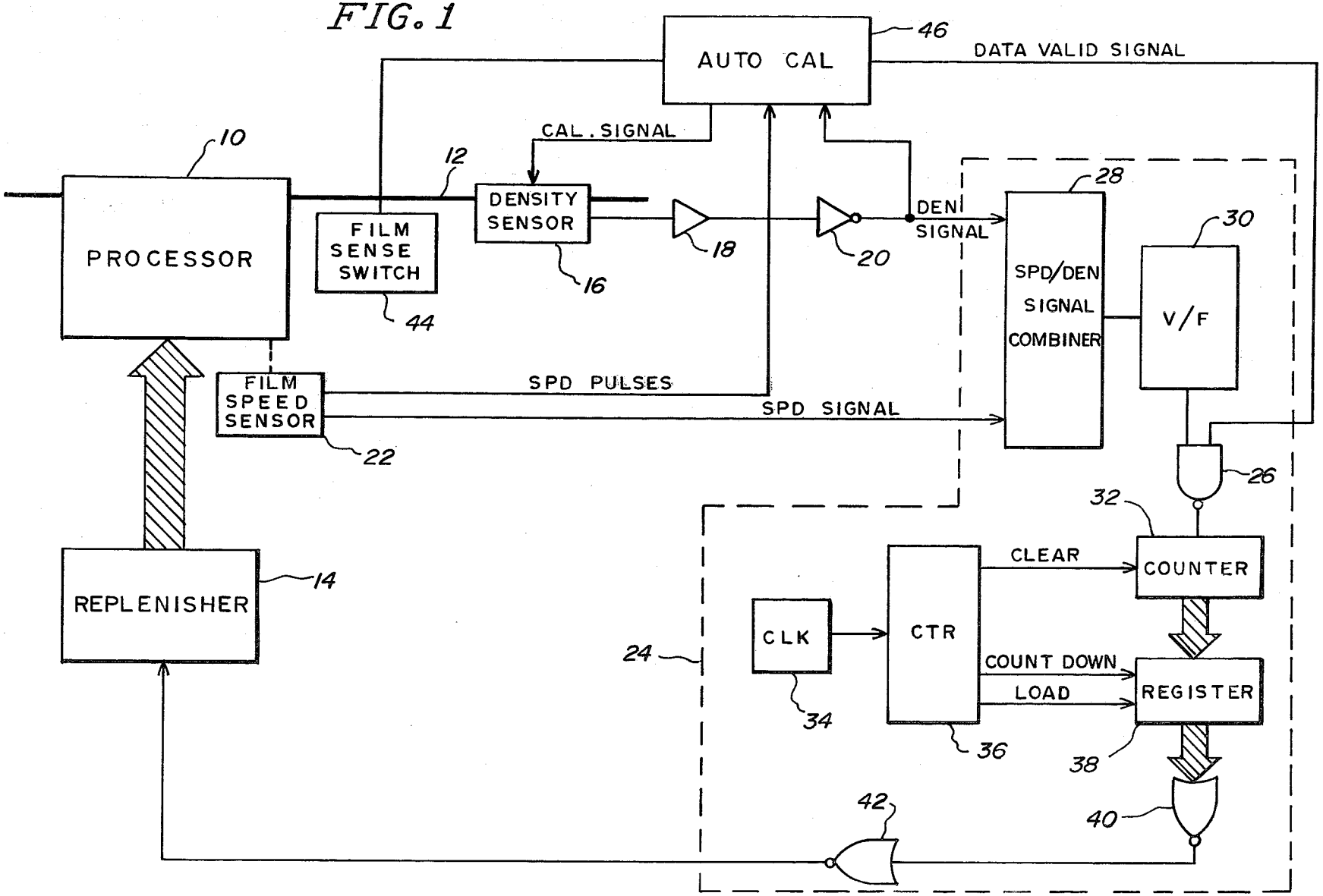
FIG. 1 is a block diagram of a replenisher system including the automatic calibration system of the present invention.

FIG. 1 shows a block diagram of a replenishment system which includes the automatic calibration system of the present invention. A processor 10 of photosensitive material 12 has its processor fluid replenished by replenisher 14. Both processor 10 and replenisher 14 may take any one of many well-known forms, such as those shown in the previously mentioned patent applications and patents.

In the embodiment shown in FIG. 1, two parameters relating to the processing occurring in processor 10 are sensed. Density sensor 16 senses the density of the developed film. The output of density sensor 16 is amplified by amplifier 18 and inverted by slope converter 20 to produce a density signal which is proportional to the image density of the developed film.

Film speed sensor 22, which may be of the type described in the previously mentioned U.S. Pat. No. 4,057,818 by Gaskell and Charnley, senses the speed at which the film 12 is being transported through processor 10. In the embodiment shown in FIG. 1, film speed sensor 22 provides a film speed signal which is proportional to the film speed through processor 10.

Density signal and the speed signal are received by a replenisher control 24, which provides an energizing signal to replenisher 14 as a function of the density and speed signals. In the embodiment shown in FIG. 1, the replenisher control 24 is identical to the replenisher control shown in the previously mentioned Charnley and Kumpula U.S. Pat. No. 4,104,670, except for the addition of NAND gate 26. It should be understood, however, that the automatic calibration system of present invention is alos applicable to other replenisher controls such as those shown in the previously mentioned patents.

Replenisher control 24, as shown in FIG. 1, includes NAND gate 26, speed/density signal combiner 28, voltage-to-frequency converter 30, counter 32, a clock circuit including clock generator 34 and counter 36, register 38, NOR gate 40 and driver or interface gate 42. The density and speed signals are supplied to control 24, and an energizing signal is supplied to replenisher 14 which has a duration which is the function of the density and speed signals.

Speed/density signal combiner 28 receives the density signal and the film speed signal and combines them to provide a combined signal. In a preferred embodiment, the combined signal is the product of the density signal and the film speed signal, and speed/density signal combiner 28 is a multiplier which multiplies the density and film speed signals.

The combined signal from speed/density signal combiner 28 is received by voltage-to-frequency converter 30. The output of voltate-to-frequency converter 30 is a variable frequency signal whose frequency is indicative of the measured parameters (density and film speed).

The variable frequency signal is NANDed by NAND gate 26 with a data valid signal, which will be discussed in detail later. When the data valid signal is high, the variable frequency signal is supplied through NAND gate 26 to counter 32, which counts up in response to the variable frequency signal. Counter 32 is interrogated at predetermined intervals by interrogate means formed by clock 34, counter 36 and register 38. Counter 36, which is driven by clock 34, has outputs which provide a Clear signal, a Load signal, and a Count Down signal.

The Load signal is provided to register 38 at predetermined intervals, such as every 30 seconds. The Load signal causes register 38 to accept the count then contained in counter 32.

The Clear signal is a short duration signal which immediately follows the Load signal. The Clear signal resets counter 32 after the count in counter 32 has been loaded into register 38. When counter 32 is a count up counter, the Clear signal resets counter 32 to zero.

The Count Down signal causes register 38 to count down from count which has been transferred from counter 32 to register 38. The time required for register 38 to count down to zero in response to the Count Down signal is determined by the count which has been loaded from counter 32.

NOR gate 40 receives all of the outputs of register 38. The output of NOR gate 40 is low only during the time that register 38 has a non-zero count. Gate 42 is a driver or interface gate which provides an energizing signal to replenisher 14. In the circuit shown in FIG. 1, the energizing signal is supplied to replenisher 14 only during the time the output of NOR gate 40 is low. In other words, the energizing signal is applied for the time duration required by register 38 to count down to zero from the count received from counter 32.

The automatic calibration system of the present invention includes film sense switch 44, auto-calibration circuit 46, and NAND gate 26 of replenisher control 24. Auto-calibration circuit 46 receives a signal from film sense switch 44, the density signal from slope converter 20, and speed pulses from film speed sensor 22. It provides a calibration bias signal to density sensor 16 and the data valid signal to NAND gate 26.

Auto-calibration circuit 46, therefore, provides two functions: (a) calibration of density sensor 16 and (b) gating of replenisher control 24. Each of these functions is initiated by a signal from film sense switch 44, which is preferably positioned about two inches ahead of the entrance to density sensor 16. Film sense switch 44 senses the presence of a strip of film 12 as it is about to enter density sensor 16.

When film sense switch 44 senses the presence of film 12, auto-calibration circuit 46 monitors the density signal and supplies a calibration bias signal to density sensor 16 before film 12 reaches density sensor 16. Density sensor 16, therefore, is calibrated just before each new strip of film 12 enters density sensor 16 and is ready to produce an accurate density signal when film 12 enters density sensor 16. This eliminates any long term drift problems, since a calibration occurs each time a strip of film 12 is about to enter density sensor 16.

The calibration of density sensor 16 is achieved by monitoring the density signal at the output of slope converter 20. When film 12 enters processor 10 but has not yet reached density sensor 16, the density signal should be a predetermined value (usually 0 volts), since no film is being sensed. Auto-calibration circuit 46 monitors the density signal and changes the calibration bias signal to density sensor 16 until the density signal is at its desired level, e.g. 0 volts. The calibration bias signal is then held at that level while the film strip 12 passes density sensor 16.

The other function of auto-calibration circuit 46 is to provide a data valid signal, which gates replenisher control 24. When film sense switch 44 senses the presence of film strip 12 and density sensor 16 has been calibrated, auto-calibration circuit 46 provides the data valid signal which is high for a period long enough to allow strip 12 to pass density sensor 16. The speed pulses from speed sensor 22 allow auto-calibration circuit 46 to coordinate the production of the data valid signal with the actual transport speed of the film 12, so that the data valid signal is high while film 12 is passing density sensor 16.

The data valid signal, therefore, gates on replenisher control 24 only for a limited period or interval after density sensor 16 has been calibrated. This is highly advantageous, since any variation in the density or speed signals is ignored by replenisher control 24 unless film is actually passing through density sensor 16 and the data valid signal is high. The data valid signal provides an additional safeguard against erroneous operation of replenisher 14.

Figure 2:
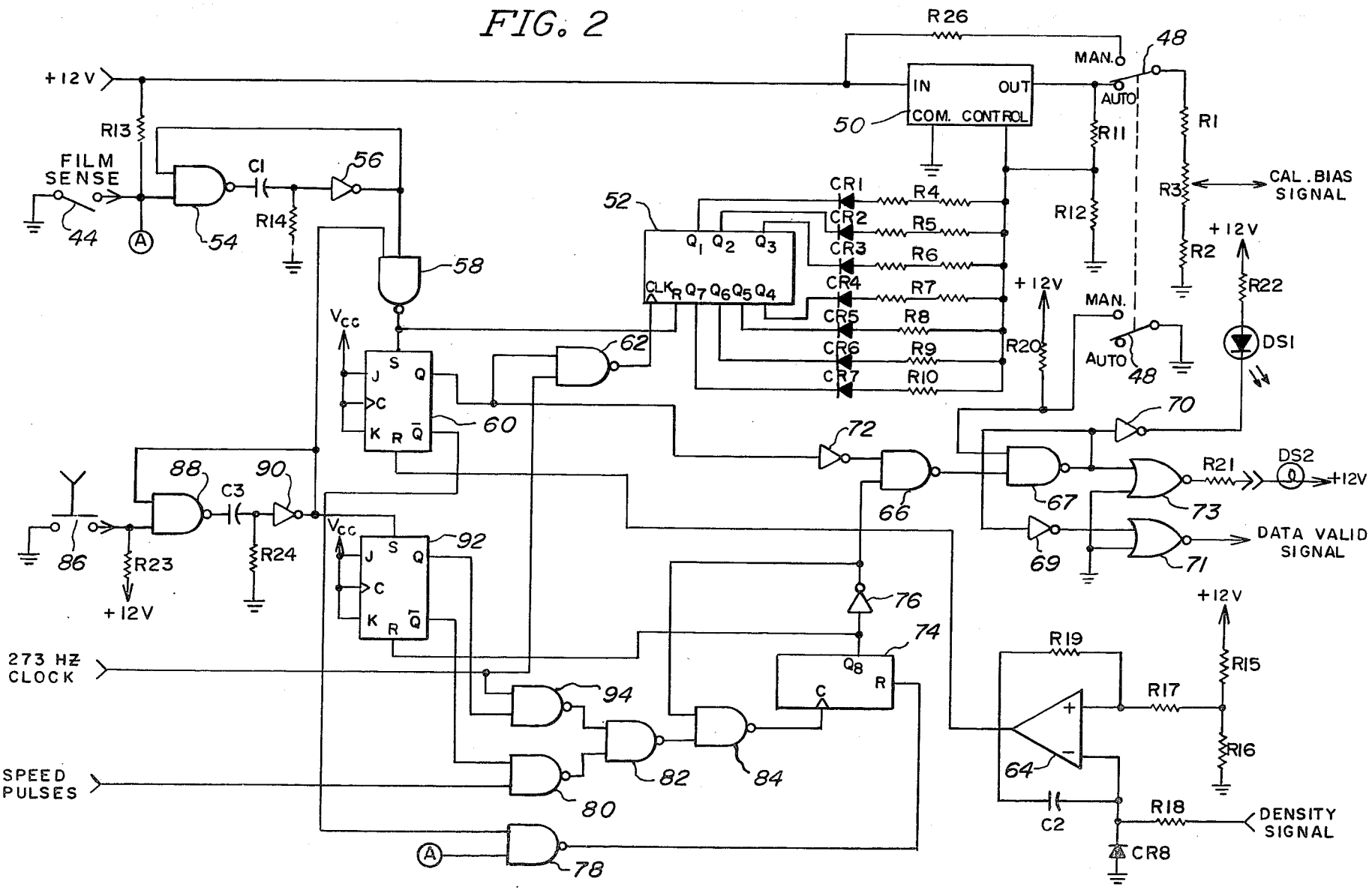
FIG. 2 is an electrical schematic diagram of a preferred embodiment of the automatic calibration system of the present invention.

FIG. 2 shows a preferred embodiment of the auto-calibration circuitry of the present invention. When auto/manual calibration switch 48 is in the auto position, the calibration signal, which is a bias voltage to density sensor 16, is controlled by the output of programmable voltage regulator 50 through a voltage divider formed by resistors R1 and R2 and potentiometer R3. The output voltage of programmable voltage regulator 50 is, in turn, controlled by binary counter 52 through diodes CR1–CR7 and resistors R4–R12. Counter 52 switches resistors R4–R10 into the voltage divider circuit of R11 and R12 so that the output of voltage regulator 50 is a stairstep ramp function. The output of voltage regulator 50 is at a maximum when counter 52 is cleared or reset and steps down in very small discrete steps to some minimum point. If counter 52 is not cleared or stopped, the stairstep down ramp is repeated.

In the present invention, the voltage output of programmable voltage regulator 50 is started at a high voltage and is stepped down by counter 52 to a voltage at which proper calibration of density sensor 16 is achieved. At this point counter 52 is stopped and the output of programmable voltage regulator 52 is held at that output. The output remains at the particular calibration point because of the digital nature of counter 52, which locks at a particular count when it is stopped. This eliminates any long term drift in the calibration voltage.

The automatic calibration function is commenced when film sense switch 44 closes. This triggers a one shot circuit formed by resistors R13 and R14, capacitor C1, NAND gate 54, and inverter 56. The output of the one shot circuit is a short pulse which is applied through NAND gate 58 to set flip flop 60 and to reset counter 52.

When flip flop 60 is set, its Q output goes high, thereby allowing the 273 Hz clock pulses to be supplied through NAND gate 62 to the clock input of counter 52. Counter 52 counts in response to the clock pulses after flip flop 60 has been set until flip flop 60 is reset by the output of the circuit which monitors the density signal. This density signal monitoring circuit includes resistors R15–R19, capacitor C2, diode CR8, and amplifier 64.

When film switch 44 has closed and flip flop 60 has been set, counter 52 begins to count and the output of programmable voltage regulator 50 begins to step downward in small increments from its maximum value. When the calibration bias voltage to the density sensor 16 reaches the point at which the density signal has its desired calibration value (which in the preferred embodiments is 0 volts) the density signal monitoring circuit senses that the calibration point has been reached and the output of amplifier 64 goes high, thereby resetting flip flop 60.

When flip flop 60 is reset, its Q output goes low, thereby preventing any further clock pulses from being applied to counter 52. The output of counter 52 is locked at its present count and remains locked until flip flop 60 is again set by another strip of film entering the processor. At this point, density sensor 16 is calibrated and is ready to provide an accurate density signal in response to film strip 12 passing through processor 10.

The second function of the auto-calibration circuit is a gating function. This function permits replenisher control 24 (shown in FIG. 1) to accept and use the density signal only for a limited time or interval after density sensor 16 has been calibrated. This limited time interval preferably corresponds to the time period during which film 12 is passing density sensor 16.

The data valid signal is determined by the output of NAND gate 66, which is NANDed by NAND gate 67 with a signal from auto/manual calibration switch 48. The output of NAND gate 67 is applied to inverters 69 and 70, and driver 73. Driver 73 controls an external annunciator light DS2 through resistor R21 and inverter 70 controls an internal annunciator light DS1 through resistor R22. The output of inverter 69 is applied to driver 71, which provides the data valid gating signal. The data valid signal is high, thereby gating on replenisher control 24, only when the output of NAND gate 66 is low.

Prior to film 12 entering density sensor 16, both inputs to NAND gate 78 (i.e. film sense switch 44 and the Q output of flip flop 60) are high, and the output of NAND gate 78, which is connected to the reset terminal of counter 74, is low. The $Q_8$ output of counter 74 is high and the Q output of flip flop 60 is low. The data valid signal, therefore, is low and replenisher control 24 is inhibited from accepting information from density sensor 16 or speed sensor 22.

When film 12 approaches density sensor 16 and is sensed by film sense switch 44, flip flop 60 is set and its Q output goes high. In addition, all outputs of counter 74, including the $Q_8$ output, go low as the result of a reset signal supplied by NAND gate 78. The outputs of counter 74 remain low until the reset is removed, which occurs when flip flop 60 is reset and film sense switch 44 opens.

When the calibration of density sensor 16 is completed, flip flop 60 is reset which stops counter 52 and causes the calibration bias voltage to be held. In addition, when flip flop 60 is reset, it causes the output of inverter 72 to go high. Since the output of inverter 76 is also high, the output of NAND gate 66 goes low, and the data valid signal goes high. The data valid signal remains high for the time required by counter 74 to count up until the $Q_8$ output goes high and the output of inverter 76 goes low.

The counting sequence of counter 74 is enabled when the reset to counter 74 is removed. The first step in removing the reset from counter 74 occurs when flip flop 60 is reset and the Q output of flip flop 60 goes high. The reset is then removed from counter 74 when film sense switch 44 opens. This occurs when the tail end of film strip 12 passes film sense switch 44.

With the reset removed, counter 74 counts in response to speed pulses which are supplied to the clock input of counter 74 through NAND gates 80, 82, and 84. The speed pulses are supplied by film speed sensor 22 of FIG. 1, with each speed pulse representing an incremental advance in film 12. The rate of counting of counter 74, therefore, is controlled by the transport speed of film 12. If film 12 is being transported slowly, the speed pulses will be produced at a lower frequency, and it will take longer for counter 74 to count up to a count at which the $Q_8$ output goes high. Conversely, if the transport speed of the film is higher, the speed pulses are produced at a higher frequency and it takes less time for counter 74 to reach a count at which the $Q_8$ output goes high.

When the $Q_8$ output of counter 74 goes high, the output of inverter 76 goes low. This causes the data valid signal to go low, thereby preventing the replenisher control 24 from accepting any other data until another strip of film approaches density sensor 16 and density sensor 16 is again automatically calibrated. The output of inverter 76 is also fed back to one input of NAND gate 84, which prevents any further speed pulses from reaching counter 74 until counter 74 has again been reset.

By proper selection of the output from counter 74 which is supplied to NAND gate 66, it is possible to ensure that the data valid signal remains high for a sufficient time for the tail of film 12 to clear density sensor 16. The data valid signal, therefore, gates on replenisher control 24 only during a time interval in which film 12 is about to or has begun to pass density sensor 16. Any drift or variation in the density and speed signals at any other time is ignored by replenisher control 24 because the data valid signal is low.

The circuit of FIG. 2, therefore, automatically calibrates density sensor 16 just before film 12 reaches density sensor 16. Manual calibration is not necessary. In addition, the circuit of FIG. 2, allows data from the density sensor 16 and film speed sensor 22 to be accepted only during a limited time interval after calibration, which corresponds approximately to the time interval during which film 12 is passing density sensor 16.

The circuit of FIG. 2 also includes circuitry which allows calibration of the system at a time other than when the film 12 is entering processor 10. By depressing switch 86, a one shot circuit formed by NAND gate 88, inverter 90, capacitor C3, and resistors R23 and R24 is triggered to produce a one shot pulse. The one shot pulse sets both flip flop 60 and flop flop 92.

When flip flop 60 is set, the automatic calibration sequence begins with counter 52 counting in response to the 273 Hz clock pulses and continues until flip flop 60 is reset by the output of amplifier 64. In other words, the calibration sequence is the same as that used when film sense switch 44 is closed by a film strip 12 about to enter density sensor 16.

The difference in operation is that the Q and Q outputs of flip flop 92 cause the 273 Hz clock pulses to be supplied to counter 74 through NAND gates 94, 82, and 84, and prevent speed pulses from being applied to counter 74 by causing one input of NAND gate 80 to go low. The data valid signal, therefore, goes high when flip flop 60 is reset and remains high for the time duration required for counter 74 to count in response to the 273 Hz clock signals until the $Q_8$ output goes high. In a preferred embodiment, this time duration is about one half second, which permits light emitting diode LED1 to flash briefly to indicate the calibration that has occurred.

The $Q_8$ output of counter 74 also resets flip flop 92 when it goes high. Flip flop 92 is held in a reset state until counter 74 is reset by the output of NAND gate 78.

Finally, the circuit of FIG. 2 permits manual adjustments of the calibration bias voltage to be made if desired. The manual adjustments may be made by placing auto/manual calibration switch 48 in the manual position. This causes resistor R26 to be connected in series with resistors R1 and R2 and potentiometer R3. The operator may change the calibration bias voltage manually by adjusting potentiometer R3. If switch 48 remains in the manual position while film is being processed in processor 10, the calibration signal will be determined by resistors R1, R2, and R26 and potentiometer R3, independent of the output voltage of programmable voltage source 50.

When auto/manual calibration switch 48 is in the manual position, the data valid signal remains high constantly, so that data is accepted by replenisher control 24 at all times. This is achieved by the input from switch 48 to NAND gate 67. When switch 48 is in the manual position, it grounds one input to NAND gate 67 thereby causing the data valid signal to be high. Conversely, when switch 48 is in the auto position, the one input to NAND gate 67 is tied through resistor R20 to +12 volts. The output of NAND gate 67 and, therefore, the data valid signal, is controlled.

Generally, manual selection of the calibration bias voltage is not desirable since it is highly operator dependent and less accurate than the automatic calibration produced by the circuit of FIG. 2. The manual adjustment of the calibration bias voltage, however, may be used in initially setting up the replenisher system to assure that the automatic calibration circuit has sufficient dynamic range to accomodate all necessary calibration bias voltages. Once this manual adjustment has been initially made, auto/manual calibration switch 48 is switched to the auto position during normal operation of the system.

In conclusion, the automatic calibration system of the present invention overcomes the problems of drift and other variations in density sensor output which are unrelated to the density being measured by the density sensor. By automatically recalibrating the density sensor each time a strip of film is about to enter the density sensor, the possibility of erroneous density signals due to long term drift, temperature variations, or other noise sources, are greatly reduced. In addition, the production of a data valid signal which gates on the replenisher control for a limited time interval assures more reliable operation of the replenisher system. By proper selection of the time interval of the data valid signal, the replenisher control is caused to ignore all signals from the density sensor except during the time interval when film is passing through the processor and the density sensor.

Although the present invention has been described with reference to preferred embodiments, workers skilled in the art will recognize that changes may be made in form and detail without departing from the spirit and scope of the invention. For example, although the present invention has been described for use in conjunction with a replenisher control of the type described in the Charnley and Kumpula U.S. Pat. No. 4,104,670, workers skilled in the art will recognize that the present invention may be used in conjunction with other replenisher controls as well. In addition, although the specific replenisher system shown in FIG. 1 includes a film speed sensor whose output is combined with the density signal, the present invention may also be used to advantage in systems having only a density sensor and in systems having parameter sensors of types other than a density sensor.

What is claimed is:

1. In a replenisher system for providing replenisher fluid to a processor of photosensitive material, the replenisher system including parameter sensing means for providing a parameter signal indicative of a measured parameter associated with the processing of the photosensitive material and including replenisher control means for controlling replenishment as a function of the parameter signal, the improvement comprising:

photosensitive material sensing means for sensing the presence of photosensitive material approaching the parameter sensing means; and calibration means for calibrating the parameter sensing means in response to a signal from the photosensitive material sensing means prior to the photosensitive material reaching the parameter sensing means.

2. The invention of claim 1 wherein the calibration means comprises:

calibration signal producing means for providing a calibration signal to the parameter sensing means in response to a signal from the photosensitive material sensing means, the calibration signal varying with time until the parameter sensing means is calibrated; and parameter signal monitoring means for monitoring the parameter signal and causing the calibration signal producing means to maintain the calibration signal at a level which causes the parameter signal to be a predetermined value, thereby calibrating the parameter sensing means.

3. The invention of claim 2 wherein the calibration signal producing means comprises:

first counter means for counting;

programmable voltage regulator means for providing the calibration signal as a function of the count of the counter means; and counter control means for starting the counter means in response to a signal from the photosensitive material sensing means and stopping the counter means in response to a signal from the parameter signal monitoring means.

4. The invention of claim 3 wherein the counter control means comprises a flip flop.

5. The invention of claim 1 and further comprising:

gating means for permitting the replenisher control means to control replenishment as a function of the parameter signal only during a time interval following calibration of the parameter sensing means by the calibration means.

6. The invention of claim 5 wherein the photosensitive material sensing means has a first state when photosensitive material is not present and a second state when photosensitive material is present.

7. The invention of claim 6 wherein the calibration means calibrates the parameter sensing means in response to a change by the photosensitive material sensing means from the first to the second state.

8. The invention of claim 5 wherein the time interval has a duration which is a function of transport speed of the photosensitive material.

9. The invention of claim 8 and further comprising:

speed sensing means for sensing the transport speed of the photosensitive material.

10. The invention of claim 9 wherein the gating means comprises:

interval start means for commencing the time interval in response to a signal indicating the calibration means has calibrated the parameter sensing means;

interval end means for ending the time interval after a change of the photosensitive material sensing means from the second to the first state and after receiving a predetermined number of signals from the speed sensing means; and data valid signal producing means for producing a data valid signal during the time interval, the data valid signal permitting the replenisher control means to use the parameter signal.

11. The invention of claim 10 wherein the interval timing means comprises second counter means for counting in response to signals from the speed sensing means.

12. The invention of claim 1 wherein the photosensitive material is film and the parameter is density of processed film, and wherein the parameter sensing means comprises density sensing means.

13. A control system for controlling replenishment of fluids to a processor of photosensitive material, the control system comprising:

density sensing means for providing a density signal indicative of density of processed photosensitive material;

replenisher control means for controlling replenishment as a function of the density signal;

photosensitive material sensing means for sensing the presence of photosensitive material approaching the density sensing means; and calibration means for sensing the density signal and supplying a calibration signal to the density sensing means in response to a signal from the photosensitive material sensing means.

14. The invention of claim 13 and further comprising:

gating means for supplying a data valid signal to the replenisher control means to permit the replenisher control means to control replenishment as a function of the density signal only during a time interval after the calibration means has sensed the density signal and supplied the calibration signal.

15. A method of supplying replenisher fluid to a processor of photosensitive material, the method comprising:

providing a signal indicative of the presence of photosensitive material approaching a density sensor;

sensing density of processed photosensitive material leaving the processor with the density sensor which produces a density signal;

monitoring the density signal, in response to the signal indicative of the presence of photosensitive material approaching the density sensor, but before the photosensitive material reaches the density sensor;

calibrating the density sensor based upon the monitoring of the density signal; and controlling replenishment of fluids to the processor as a function of the density signal after calibrating.

16. In a replenisher system for providing replenisher fluid to a processor of photosensitive material, the replenisher system including parameter sensing means for providing a parameter signal indicative of a measured parameter associated with the processing of the photosensitive material and including replenisher control means for controlling replenishment as a function of the parameter signal, the improvement comprising:

calibration means for calibrating the parameter sensing means prior to each time a front end of a strip of photosensitive material reaches the parameter sensing means; and gating means for permitting the replenisher control means to use the parameter signal only during a time interval which commences with calibration and continues while the strip is passing the parameter sensing means.

* * * * *